United States Patent [19]

Menard

[11] Patent Number: 4,940,074

[45] Date of Patent: Jul. 10, 1990

[54] CORE PINNING MACHINE

[75] Inventor: Alan W. Menard, Bolton, Conn.

[73] Assignee: United Technologies Corporation, Hartford, Conn.

[21] Appl. No.: 880,602

[22] Filed: Jun. 30, 1986

[51] Int. Cl.[5] ..... B22C 19/00; B23D 23/00

[52] U.S. Cl. ..... 164/412; 83/199; 140/123.6

[58] Field of Search ..... 83/196, 199; 140/123.6; 29/564.6, 564.8, 566.1; 164/412

[56] References Cited

U.S. PATENT DOCUMENTS

| | | | |
|---|---|---|---|
| 2,963,785 | 12/1960 | Dilling | 83/196 |
| 3,596,703 | 8/1971 | Bishop et al. | 164/132 |
| 3,662,816 | 5/1972 | Bishop et al. | 164/366 |
| 4,068,702 | 1/1978 | Herold | 164/30 |
| 4,078,598 | 3/1978 | Kelso et al. | 164/30 |
| 4,283,835 | 8/1981 | Obrochta et al. | 29/527 |
| 4,474,224 | 10/1984 | Higginbotham et al. | 164/150 |
| 4,487,246 | 12/1984 | Frasier | 164/32 |

FOREIGN PATENT DOCUMENTS

| | | | |
|---|---|---|---|
| 721256 | 3/1980 | U.S.S.R. | 83/199 |
| 733886 | 5/1980 | U.S.S.R. | 83/199 |
| 772753 | 10/1980 | U.S.S.R. | 83/196 |
| 1026978 | 7/1983 | U.S.S.R. | 83/196 |

*Primary Examiner*—Richard K. Seidel

*Attorney, Agent, or Firm*—Keven E. McVeigh

[57] ABSTRACT

A core pinning machine (1) includes a rotatable wire cutting apparatus (6) which comprises a housing (10), a cylinderical shank (13) rotatable within the housing, a cutter (18) with a sharp edged orifice (20) abutted to an end of the shank and a wire guide passage (17) located within the shank parallel to and offset from a central longitudinal axis (16) of the shank. The passage is rotatably alignable with the cutting orifice, allowing passage of the wire through the wire cutting apparatus. The wire cutting apparatus is disposed in a heater (25) which heats the wire as it passes therethrough, with the heated wire then inserted into a wax pattern (7) until a core (8) is contacted. A timer controller (2) registers the stop, and, after a delay, signals an actuator (23) to rotate the shank, which causes misalignment of the passage with the cutter, severing the wire against the sharp edge of the orifice. Incorporation of the rotatable wire cutting apparatus in the core pinning machine provides variable length pins for supporting cores in different depth investment casting wax patterns without retooling.

9 Claims, 4 Drawing Sheets

CORE PINNING MACHINE

DESCRIPTION

1. Technical Field

This invention relates to wire cutting apparatus and more particularly to machines for cutting and inserting core supporting pins into investment casting wax patterns.

2. Background Art

Investment casting provides relatively precise dimensional tolerances, excellent surface finishes and accurate methods for providing holes and passages within cast articles. Generally, investment casting is a "lost wax" process where a mold is formed around a wax pattern which is shaped to resemble a desired article. During casting, the wax is displaced by molten metal, which upon cooling, forms the desired article. Holes and internal passages are provided by precisely positioning cores of silica or other ceramic materials in the wax pattern, which are not displacable by the molten metal. After casting, the cores are chemically leached or otherwise removed, thereby providing the desired holes and passages.

Investment casting is extensively used in the production of superalloy blades and vanes for gas turbine engines, particularly those requiring internal cooling passages. To achieve the critical tolerances required for aerodynamic efficiency necessitates precise positioning of the core within the wax pattern, requiring a reliable support system to prevent core movement during removal of the wax and addition of the molten metal. In U.S. Pat. No. 3,662,816 to Bishop et al, a mold structure is disclosed which utilizes a plurality of thin metallic pins to support a ceramic core within a mold. Generally, such pins are cut from a wire material, heated and manually inserted into the wax pattern. The wax can then be removed without causing movement of the core. However, a substantial amount of time and effort is required to complete this manual operation.

In U.S. Pat. No. 4,474,224 to Higginbotham et al, a machine is disclosed for inserting core supporting pins into a wax pattern. While a significant improvement over manual insertion, there are several limitations. This machine includes automatic cutting means in the form of a piston cutter (See FIG. 3 of Higginbotham, reproduced as FIG. 6). A wire is inserted into a chamber and the sharp edged piston cutter, drawn perpendicular to the wire, shears the wire pin and moves it into a holder. A second piston is then actuated which pushes the wire pin out of the holder and into the wax pattern. This double piston apparatus produces only one length pin, determined by the cutting piston diameter, and has a maximum penetration depth determined by the limited stroke of the second piston. Such a machine is therefore limited to pinning cores in molds having a narrow range of wax thicknesses. Consequently, the machine must be retooled to accommodate variable depth wax patterns, which require pins of varying length.

DISCLOSURE OF INVENTION

It is an object of the present invention to provide a core pinning machine which produces core supporting wire pins of varying lengths without retooling.

It is a further object of the present invention to simplify the complex cutting and insertion apparatus incorporated in a core pinning machine, thereby increasing equipment reliability.

These and other objects of the present invention are achieved by providing a rotatable wire cutting apparatus which includes a housing, a rotatable cylinderical shank disposed within the housing, and a wire guide passage which is located within the shank, parallel to and offset from a central longitudinal axis of the shank. A cutter abuts the end of the shank and has a sharp edged orifice which is aligned with the wire guide passage through rotation of the shank.

In a core pinning machine, the rotatable wire cutting apparatus is disposed in alignment with a wire feed mechanism and aimed at a wax pattern. The housing is attached to the machine and fitted with a heating jacket, heating the housing, shank and cutter. In operation, the wire guide passage and orifice are in axial alignment and the wire fed through until the desired length of wire has passed. As the wire passes therethrough, it is heated above the melting point of the wax and then inserted into the wax pattern. When the wire feed is stopped, a mechanism is actuated which rotates the shank, driving the wire guide passage in an arc away from the cutter, severing the wire against the sharp edge of the orifice. The shank is then rotated again, realigning the passage with the orifice, for the next wire pin insertion. Such a machine incorporating a rotatable wire cutting apparatus provides variable length pins adaptable to any mold regardless of wax thickness without retooling and eliminates the double piston mechanism of the prior art for cutting, moving and inserting a pin into a wax pattern.

BEST MODE FOR CARRYING OUT THE INVENTION

Figure 3:
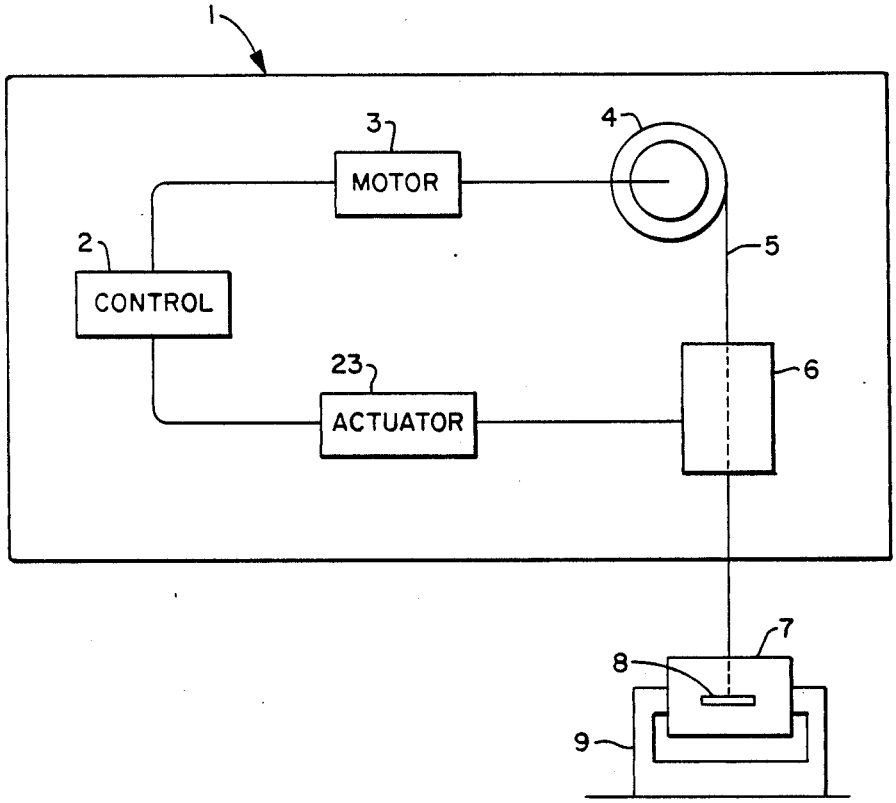
FIG. 3 shows a sectional view along line 2—2 of FIG. 2.

Referring to FIG. 3, a core pining machine 1 is shown in schematic form. The machine 1 includes control means 2 controlling a feed motor 3 which turns a wire spool 4, containing a continuous length of wire 5. The wire 5 is thereby fed through a wire cutting apparatus 6 into a wax pattern 7 which includes a ceramic core 8. The wax pattern 7 is held by supporting means 9, which may be any suitable clamping or fixing device. While such a core pinning machine is exemplary of the present invention, it will be understood by those skilled in the art that any machine adapted for cutting wire could benefit from the present invention.

Figure 2:
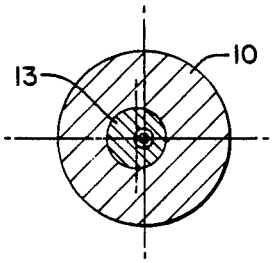
FIG. 2 is a cross sectional view of the wire cutting apparatus of the present invention.
Figure 1:
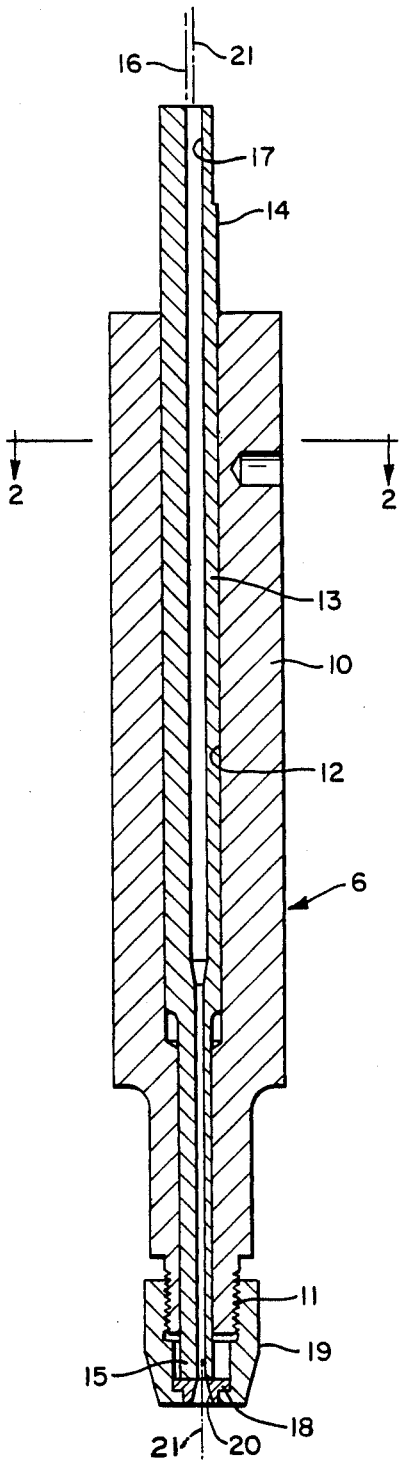
FIG. 1 is a schematic illustration of the core pinning machine of the present invention.

Referring to FIG. 1, the rotatable wire cutting apparatus 6 includes a housing 10, having a threaded end 11 and a shank retaining chamber 12. A cylindrical shank 13 is disposed within the chamber 12 of the housing 10 and rotatable therein about a central longitudinal axis 16 of shank 13. The shank 13 has a drive end 14 and a cutting end 15. An eccentrically located wire guide passage 17 longitudinally extends from the drive end 14 to the cutting end 15. The passage 17 is parallel to and offset from the longitudinal axis 16 of the shank 13. A cutter 18 is abutted to the cutting end 15 of the shank 13 and retained in housing 10 at the threaded end 11 by a nut 19. The cutter 18 includes a sharp edged orifice 20 which preferably has a diametric opening approximating the diameter of the wire 5. The orifice has a central longitudinal axis 21 parallel to the shank axis 16, with the passage 17 offset from the axis 16 in an amount suffient to allow axial alignment of the passage 17 with the orifice 20 (see FIG. 3), while also providing for total misalignment on rotation of shank 13. Total misalignment is required to assure complete severing of the wire located therein.

In operation, the shank 13 is rotated until the passage 17 is in alignment with the orifice 20, with the wire 5 then fed therethrough. For ease of feeding wire through the inventive wire cutting apparatus, the wire guide passage 17 may provide a large opening at the drive end 14 and taper down to the cutting end 15, with the opening at the cutting end 15 matching the diameter of the orifice 20. In the preferred embodiment, a first portion of the passage 17 has a large diameter for ease of loading wire, with a tapered mid portion for transition to a wire support portion which leads to the orifice 20. The diameter of the wire support portion approximates the diameter of the wire 5.

For illustrative purposes, the wire 5 is platinum wire having a diameter of 0.020 inches. While such a wire is exemplary, any size wire may be used with the wire cutting apparatus of the present invention by providing the appropriatly sized passage and cutter orifice. A change to another wire diameter could be quickly effected by replacing the shank 13 and the cutter 18, both of which are easily removable without causing significant production delays.

When the desired length of wire has passed the orifice 20, the wire feed is stopped and the shank 13 is rotated, causing the passage 17 to circumscribe an arc about the axis 16 resulting in misalignment of the passage 17 with the orifice 20. The wire 5, disposed therein, is thereby pressed against the sharp edge of the orifice 20, severing the wire. Rotating the shank 13 into realignment of the passage 17 with the orifice 20 resets the wire cutting apparatus.

Figure 4:
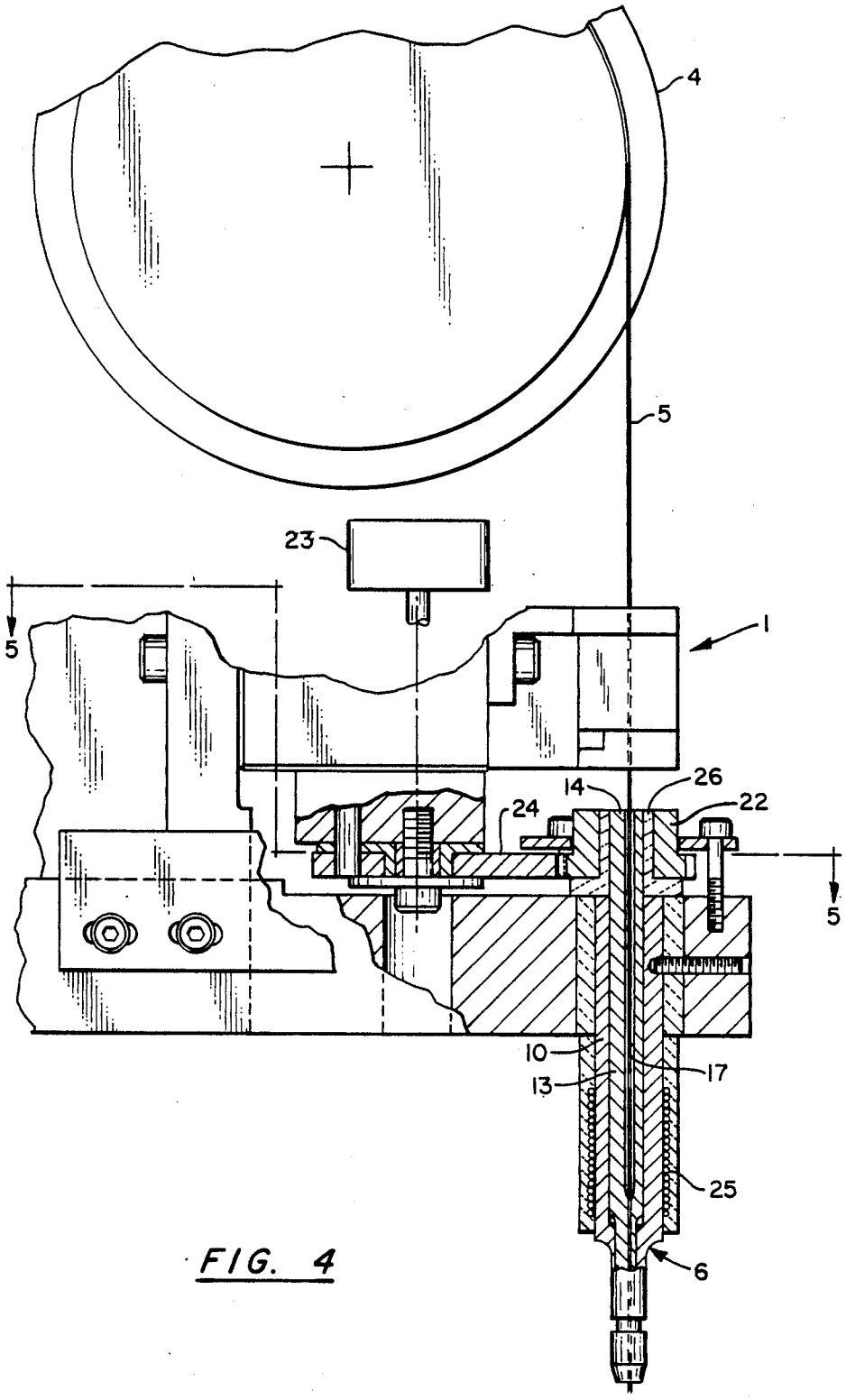
FIG. 4 is a partial sectional elevation of the core pinning machine of the present invention.
Figure 5:
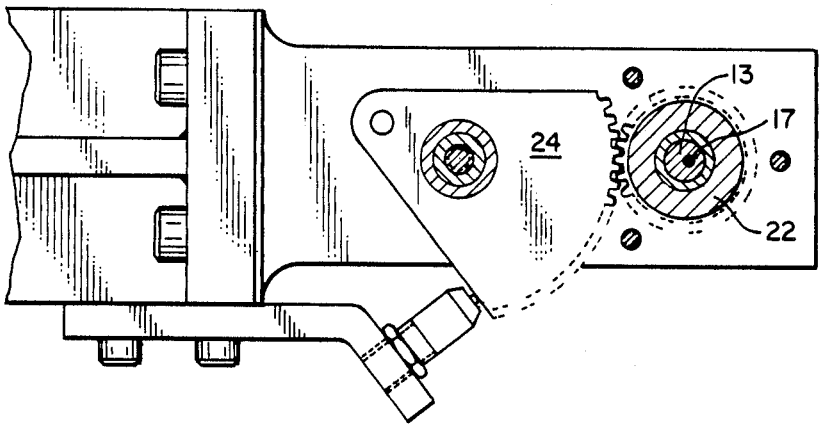
FIG. 5 shows a sectional view along line 5—5 of FIG. 4.
Figure 6:
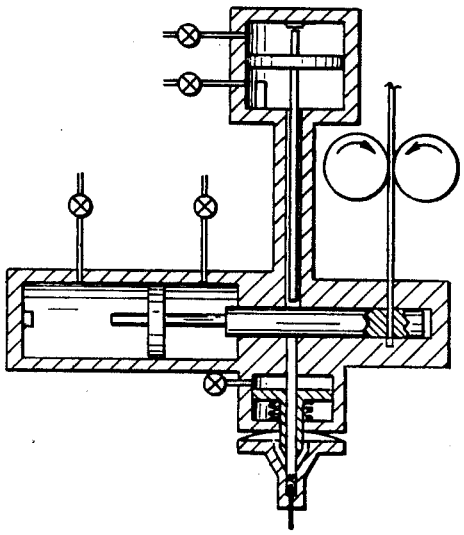
FIG. 6 PRIOR ART
FIG. 6 is a cross sectional view of the prior art core pinning machine.

Refering to FIG. 4, the wire cutting apparatus 6 is longitudinally positioned on the core pinning machine 1 to allow feed through of the pinning wire 5 from the spool 4 into the wax pattern 7 (see FIG. 3). The housing 10 is fixably positioned on the machine 1 and the shank 13 is fitted with a shank gear 22 on the drive end 14. A pneumatic rotary actuator 23 is used to rotate a drive gear 24 which engages the shank gear 22. For illustrative purposes, the drive gear 24 is wedge shaped (see FIG. 5), providing 45 degree rotation and counterrotation of the shank 13. Such an arrangement facilitates precise realignment of the passage and the orifice. However, with the appropriate drive gear and actuator system, full 360 degree rotation may also be used.

A heater 25 is disposed about the housing 10 and heats the housing and the shank disposed therein. The heater may comprise an electrical coil wrapped around the housing which is covered with a fiberglass insulating material for energy efficiency and operator protection. An insulated bushing 26 similarly insulates and isolates the heated assembly from the shank gear 22. The wire 5 is heated above the melting point of the wax as it is fed through the passage 17 into the wax pattern 7, with the control means 2 controlling the depth of pin insertion by stopping the wire feed motor 3. After insertion, the control means 2 signal the rotary actuator 23 to rotate the shank 13, cutting the wire 5. After the wire is cut, the control means signal the actuator to counterrotate the shank, realigning the passage with the orifice. The core pinning machine is then repositioned for a second pin insertion.

The control means, which may also be utilized to control the machine position relative to the wax pattern, may comprise any adaptable analog or digital control system such as a microprocessor unit. In the preferred embodiment, a pressure balancing device is utilized to provide a precise wire insertion pressure, feeding the wire into the wax pattern until the resistance to feeding overcomes the insertion pressure. This occurs when either a core is contacted or when a positive stop is met. An adjustable timer registers the halt in the wire feed, and, after a delay, signals the rotary actuator to cut the wire.

Incorporation of the rotatable wire cutting apparatus in a core pinning machine facilitates core pinning in variable depth wax patterns without retooling. Maintenance is simplified as the cutter is the only part subject to wear and it is easily replacable. Also, with the provision for providing variable length pins, through pinning of a wax pattern can be effected, either by adjusting the timer control setting or by including an adjustable stop positioned on the far side of the wax pattern. Utilizing the inventive core pinning machine eliminates the complicated prior art pneumatic piston cutters with their associated seals and valves, increasing overall equipment reliability.

While this invention is discussed in relation to a core pinning machine, it will be understood by those skilled in the art that modifications in terms of machine type, apparatus alignment, wire type, composition or control means can be made without varying from the present invention.

Having thus described the invention, what is claimed is:

1. A wire cutting apparatus characterized by:

a housing;

a cylindrical shank disposed within said housing and rotatable therein, said shank including a central longitudinal axis and a cutting end, said shank further including a wire guide passage longitudinally extending therethrough, parallel to and offset from said central longitudinal axis, wherein the diameter of said passage tapers downwardly to substantially the diameter of the wire to be cut, a cutter abutted to the cutting end of said shank, said cutter having a sharp edged orifice; and, means for rotating said shank within said housing such that said passage is rotatable into alignment with said orifice such that a wire is passable therethrough;

wherein rotating said shank totally misaligns said passage with said orifice, severing said wire therein.

2. A core pinning machine adapted for inserting a core supporting wire pin of variable length into a wax pattern, said machine characterized by:

means for providing and feeding a continuous length of wire;

means for heating the wire prior to insertion into said wax pattern; and, means for cutting the wire, said cutting means including a housing, a cylinderical shank disposed within said housing and rotatable therein, said shank including a central longitudinal axis and a cutting end, said shank further including a wire guide passage longitudinally extending therethrough, parallel to and offset from said central longitudinal shank axis, a cutter, abutted to the cutting end of said shank, said cutter having a sharp edged orifice, and, means for rotating said shank within said housing such that said passage is rotatable into alignment with said orifice, such that a wire is passable therethrough, wherein rotating said shank totally misaligns said passage with said orifice, severing said wire therein.

3. The core pinning machine of claim 2 wherein the diameter of said passage tapers downwardly to sustantially the diameter of the wire.

4. The core pinning machine of claim 3 wherein said passage includes a large diameter portion for ease in loading said wire, a transition portion for narrowing the passage diameter and a wire support portion which has a diameter substantially matching the diameter of said wire.

5. The core pinning machine of claim 2 wherein said rotating means comprise a pneumatic rotary actuator coupled to a drive gear in engagement with a shank gear attached to said shank.

6. The core pinning machine of claim 5 further characterized by means for controlling the length of wire to be cut by stopping the wire feed means on contact with a core or a positive stop, and by actuating the rotary actuator.

7. The core pinning machine of claim 6 wherein said means for controlling the length of wire comprises a pressure balancing device which provides a precise wire insertion pressure, feeding the wire into the wax pattern until the resistance to feeding overcomes the insertion pressure.

8. The core pinning machine of claim 7 further characterized by including an adjustable timer which registers a hault in the wire feed and, after a controllable delay, signals the rotary actuator to cut the wire.

9. A wire cutting apparatus characterized by:

a housing;

a cylindrical shank disposed within said housing and rotatable therein, said shank including a central longitudinal axis and a cutting end, said shank further including a wire guide passage longitudinally extending therethrough, parallel to and offset from said central longitudinal axis, wherein the said passage includes a large diameter portion for ease in loading said wire, a transition portion for narrowing the passage diameter and a wire support portion which has a diameter substantially matching the diameter of said wire;

a cutter abutted to the cutting end of said shank, said cutter having a sharp edged orifice; and, means for rotating said shank within said housing such that said passage is rotatable into alignment with said orifice such that a wire is passable therethrough;

wherein rotating said shank totally misaligns said passage with said orifice, severing said wire therein.

* * * * *